US005431225A

United States Patent [19]

Abass et al.

[11] Patent Number: 5,431,225

[45] Date of Patent: Jul. 11, 1995

[54] SAND CONTROL WELL COMPLETION METHODS FOR POORLY CONSOLIDATED FORMATIONS

[75] Inventors: Hazim H. Abass, Duncan; David L. Meadows, Rush Springs; John L. Brumley; David E. McMechan, both of Duncan, all of Okla.; James J. Venditto, Sugarland, Tex.

[73] Assignee: Halliburton Company, Duncan, Okla.

[21] Appl. No.: 310,174

[22] Filed: Sep. 21, 1994

[51] Int. Cl.[6] ..... E21B 43/267

[52] U.S. Cl. ..... 166/280; 166/308; 166/50

[58] Field of Search ..... 166/308, 280, 281, 295, 166/50; 175/4.51

[56] References Cited

U.S. PATENT DOCUMENTS

| | | | |
|---|---|---|---|
| 3,372,752 | 3/1968 | Prater | 166/280 |
| 3,687,203 | 8/1972 | Malone | 166/308 |
| 4,010,802 | 3/1977 | Miles et al. | 166/281 |
| 4,157,116 | 6/1979 | Coulter | 166/280 |
| 4,723,604 | 2/1988 | Emery | 166/280 |
| 4,974,675 | 12/1990 | Austin et al. | 166/250 |
| 4,977,961 | 12/1990 | Avasthi | 166/308 X |
| 5,105,886 | 4/1992 | Strubhar et al. | 166/280 |
| 5,128,390 | 7/1992 | Murphey et al. | 523/130 |
| 5,318,123 | 6/1994 | Venditto et al. | 166/250 |

OTHER PUBLICATIONS

SPE Paper No. 28555 entitled "Oriented Perforations—A Rock Mechanics View" by Hazim H. Abass, David L. Meadows, John L. Brumley, Saeed Hedayati and James J. Venditto, Halliburton Energy Services, to be presented at the SPE Annual Technical Meeting, New Orleans, Louisiana, Sep. 25-28, 1994.

*Primary Examiner*—Stephen J. Novosad

*Attorney, Agent, or Firm*—Robert A. Kent; C. Clark Dougherty, Jr.

[57] ABSTRACT

Methods of completing poorly consolidated subterranean formations bounded by one or more consolidated formations to prevent sand production from the poorly consolidated formations are provided. The methods basically comprise the steps of drilling a well bore into the consolidated boundary formation adjacent to the poorly consolidated formation, creating a propped fracture communicating with the well bore in the consolidated boundary formation which extends into the poorly consolidated formation and producing fluids from the poorly consolidated formation into the well bore by way of the propped fracture.

20 Claims, 2 Drawing Sheets

SAND CONTROL WELL COMPLETION METHODS FOR POORLY CONSOLIDATED FORMATIONS

BACKGROUND OF THE INVENTION

1. Field of the Invention

The present invention relates to completion methods for poorly consolidated formations, and more particularly, to methods of completing poorly consolidated formations whereby sand production is eliminated or reduced.

2. Description of the Prior Art

The migration of sand particles with fluids produced from soft or poorly consolidated formations has been a continuous problem. While numerous techniques have been developed for controlling sand production including placing screens and/or gravel packs between the sand producing formations and the well bores penetrating them, utilizing hardenable resin coated particulate material to form consolidated gravel packs, contacting the near well portions of poorly consolidated formations with consolidating fluids which subsequently harden, etc., sand production problems have continued. Sand production usually results in lost hydrocarbon production due to the plugging of gravel packs, screens and perforations as well as production equipment such as flow lines, separators and the like.

When a formation is penetrated by a well bore, the near well bore material making up the formation must support the stress that was previously supported by the removed formation material. In a poorly consolidated rock formation, this stress overcomes the formation strength which causes the formation to breakdown and sand to migrate into the well bore with produced fluids. As the poorly consolidated formation is produced over time, the breakdown of the formation progresses throughout the reservoir and the production of sand continues.

Thus, there is a need for improved methods of completing poorly consolidated subterranean formations whereby well bores or other circular holes are not created in the formation and the stress failures which bring about sand production are eliminated.

SUMMARY OF THE INVENTION

Improved methods of completing poorly consolidated formations which prevent sand production are provided by the present invention which meet the need described above and overcome the shortcomings of the prior art. The methods basically comprise the steps of drilling a well bore, preferably a horizontal well bore, into a consolidated boundary formation adjacent to the poorly consolidated producing formation to be completed, and then forming at least one propped fracture in the consolidated boundary formation which communicates with the well bore and extends into the poorly consolidated formation. Fluids from the poorly consolidated formation are produced into the well bore by way of the propped fracture.

The fracture or fractures produced are preferably propped with a consolidated resin coated particulate material over their entire lengths whereby stress failures along the fractures are prevented. The fractures are also preferably created by first producing a plurality of directionally oriented perforations in the well bore followed by applying hydraulic pressure to the perforations in an amount sufficient to fracture the consolidated boundary formation and extend the fracture into the poorly consolidated formation. The directionally oriented perforations are arranged to produce the most conductive fracture possible.

Thus, it is a general object of the present invention to provide improved well completion methods for poorly consolidated formations which prevent sand production from the formations.

Other and further objects, features and advantages of the present invention will be readily apparent to those skilled in the art upon a reading of the description of preferred embodiments which follows when taken in conjunction with the accompanying drawings.

DESCRIPTION OF PREFERRED EMBODIMENTS

As mentioned, the methods of the present invention allow a poorly consolidated formation to be completed in a manner whereby sand production from the formation is prevented. Such poorly consolidated hydrocarbon producing formations are usually bounded by consolidated formations which are relatively non-productive. The term "poorly consolidated formation" is used herein to mean that the formation is formed of generally friable sand. When a well bore is drilled into such a formation, a plastic zone develops around the well bore and formation breakdown within the plastic zone is the main source of sand production. As formation fluids are produced from the formation, the plastic zone is expanded and sand production continues. The term "consolidated formation" is used herein to mean a rock formation in which the in-situ stresses are in equilibrium. While the drilling of a well bore in a consolidated formation causes the in-situ stresses to deform around the well bore and a stress concentration zone to be formed, the mechanical properties of the rock making up the formation are such that the stress concentration does not cause formation break down.

Figure 1:
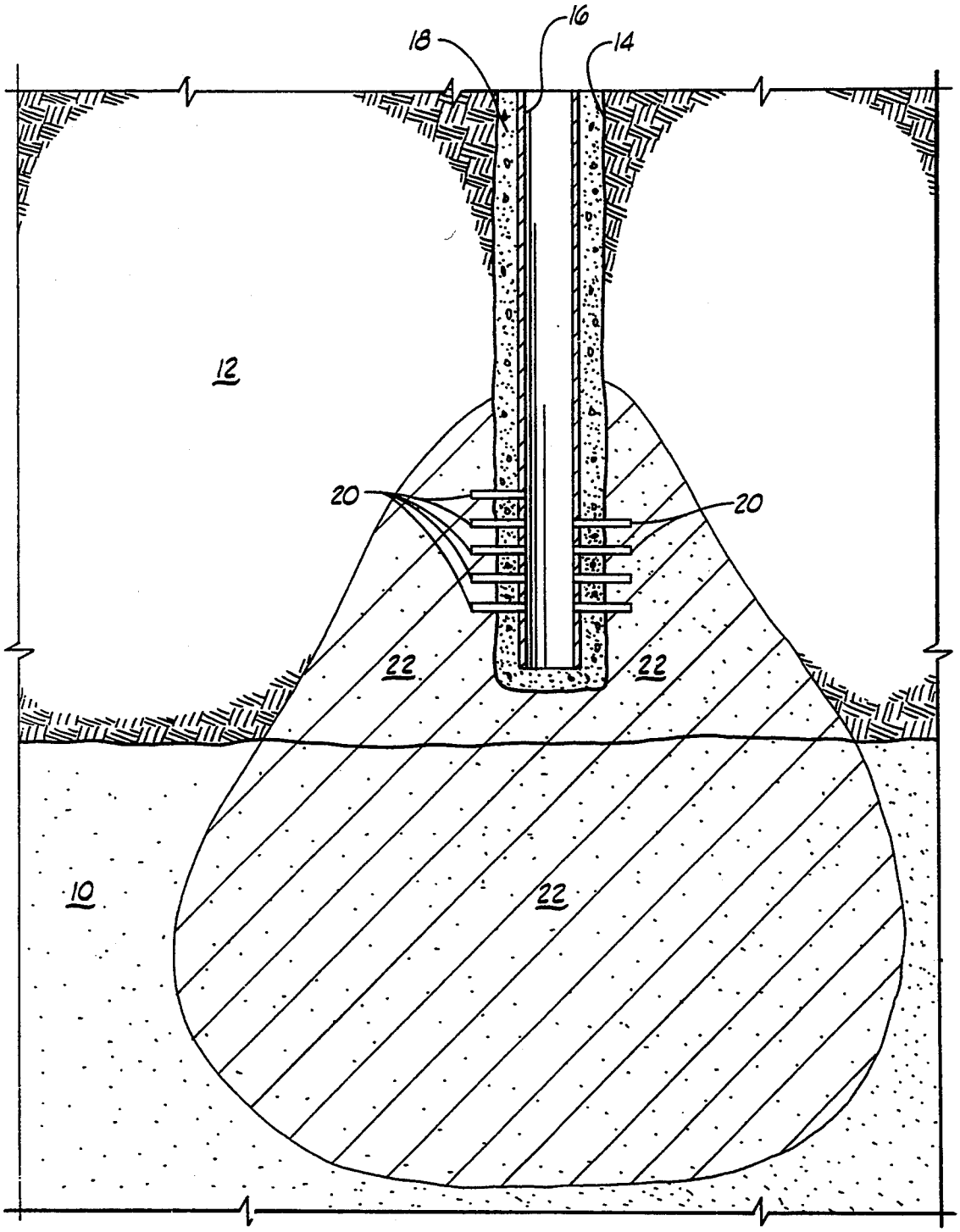
FIG. 1 is a schematic illustration of a subterranean poorly consolidated formation bounded by a consolidated formation which has a vertical well bore drilled therein and a fracture formed therein communicating the well bore with the poorly consolidated formation.
Figure 2:
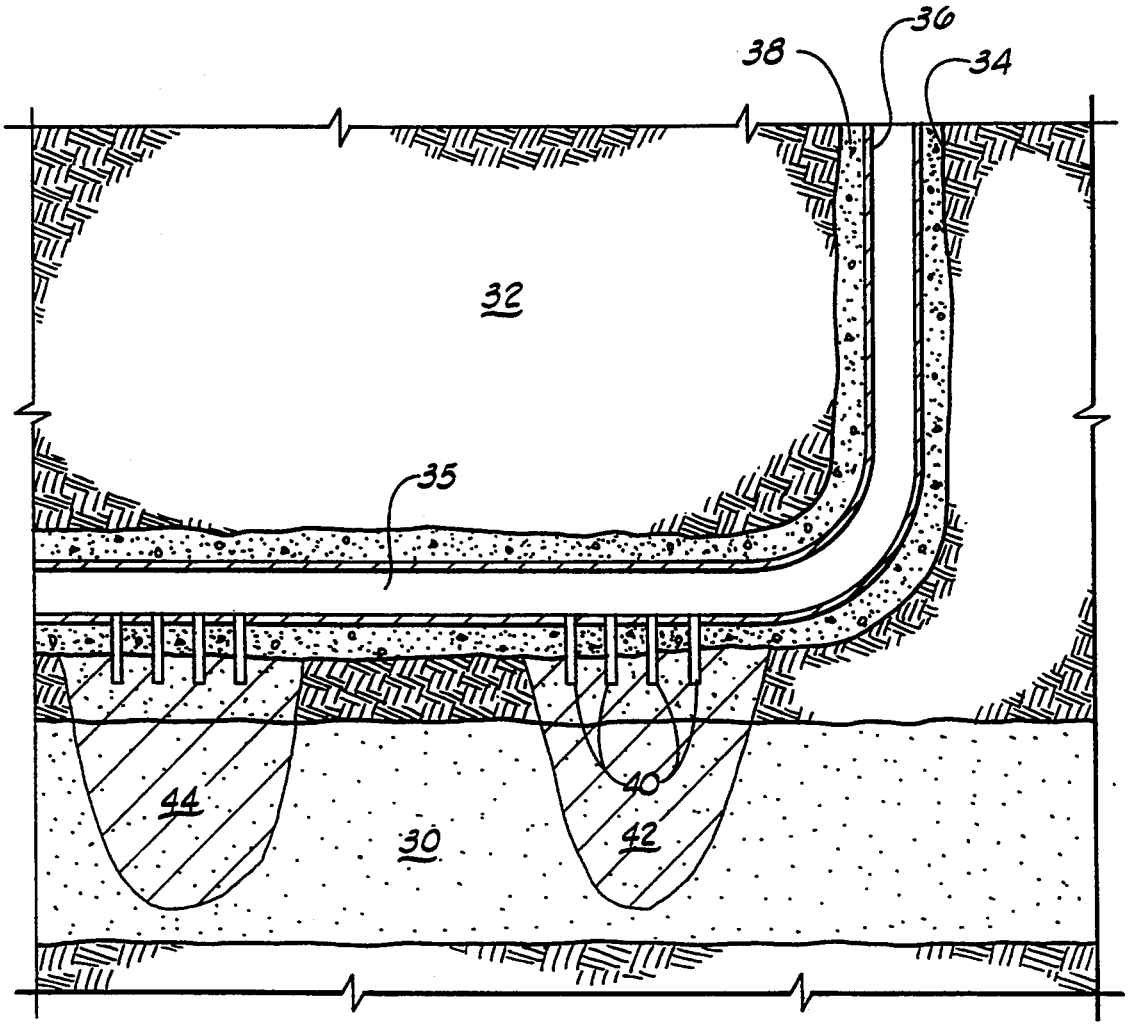
FIG. 2 is a schematic illustration of a poorly consolidated formation bounded by a consolidated formation which has a horizontal well bore drilled therein and a pair of fractures formed therein communicating the well bore with the poorly consolidated formation.

In carrying out the methods of the present invention, the first step is to drill a well bore into a boundary consolidated formation adjacent to the poorly consolidated formation to be completed. The well bore can be either vertical as shown in FIG. 1 or horizontal as shown in FIG. 2. However, it is preferable that a horizontal well bore be drilled into the consolidated formation above the poorly consolidated formation for reasons which will be described further hereinbelow.

Referring to FIG. 1, a poorly consolidated formation 10 is illustrated positioned below a consolidated formation 12. A vertical well bore 14 is drilled into the consolidated formation 12, close to but not into the poorly consolidated formation 10. The well bore 14 is completed conventionally, e.g., it contains casing 16 surrounded by a cement sheath 18. Other known completion methods can also be used such as open hole, sliding sleeves, liner, etc.

After the casing 16 has been cemented in the well bore 14, an interval of the well bore adjacent to the poorly consolidated formation 10 is perforated. That is, a plurality of directionally oriented perforations 20 are formed in an about 1 to about 5 foot interval in the well bore 14 which extend through the casing 16 and the cement 18 and into the consolidated formation 12. The perforations are formed utilizing conventional perforation forming equipment and known orienting techniques.

The particular arrangement and alignment of the perforations 20 are such that when a hydraulic pressure is applied to the perforations from within the well bore 14, one or more fractures are formed in the consolidated formation 12 which can be extended into the poorly consolidated formation 10.

It is known that when fractures are created from a substantially vertical well bore in a formation, two vertical fracture wings are generally produced which extend from opposite sides of the well bore at right angles to the in-situ least principle stress in the formation. Stated another way, the fractures extend in the direction of the maximum horizontal stress in the formation. Thus, a knowledge of the direction of the maximum horizontal stress in the consolidated formation 12 is advantageous and can be determined by a number of well known methods. In one such method, the formation is subjected to fracturing before the well is cased by applying hydraulic pressure to the formation by way of the well bore. When a fracture forms, the maximum horizontal stress direction can be determined from the direction of the formed fracture using a direction oriented fracture impression packer, a direction oriented well bore television camera or other similar tool. A preferred method of determining the maximum horizontal stress direction is disclosed in U.S. Pat. No. 4,529,036 to Daneshy et al. issued Jul. 16, 1985 which is incorporated herein by reference. In accordance with that method, a fracture is created during drilling by exerting hydraulic pressure with drilling fluid by way of the drill pipe on the bottom of the well bore. The fracture formed extends from the lower end portion of the well bore and a location oriented core containing a portion of the fracture is removed from the well bore. The direction of the fracture in the core determines the direction of the maximum horizontal stress in the formation and the direction that fractures created in the formation will extend.

In performing the method of the present invention utilizing the vertical well bore 14 and if it is possible to do so, the perforations 20 are preferably aligned with the maximum horizontal stress in the formation 12 to intersect the poorly consolidated formation 10. The reason for this is that the widest fractures having the least flow resistance are those formed in the direction of the maximum horizontal stress. Also, the perforations 20 are preferably positioned in a 180° phasing, i.e., whereby perforations extend from opposite sides of the well bore as shown in FIG. 1.

After the perforations 20 are formed, hydraulic pressure is applied to the perforations by pumping a fracturing fluid into the perforations and into the formation 12 at a rate and pressure such that the consolidated formation 12 fractures. As the hydraulic pressure is continued, a vertical fracture 22 is extended from the well bore 14 in opposite directions in alignment with the maximum horizontal stress in the consolidated formation 12. When the fracture 22 reaches the poorly consolidated formation 10, it is rapidly extended into the poorly consolidated formation 10 as illustrated in FIG. 1. The rapid extension of the fracture 22 into the poorly consolidated formation 10 diverts the energy of the fracturing fluid into the formation 10, and it stops growing into the consolidated formation 12.

Thus, the fracture 22 starts at the perforations 20 and progresses into the poorly consolidated formation 10. The directionally oriented perforations 20 provide an initiation point for application of the hydraulic pressure created by the introduction of fracturing fluid into the formation 12, and cause the fracture 22 to extend from the well bore 14 in the desired direction of maximum horizontal stress thereby minimizing fracture reorientation and the consequent restriction in the width of the formed fracture. Minimizing reorientation reduces the initial pressure that must be applied to achieve formation breakdown, reduces the pressure levels necessary to extend a created fracture, maximizes the fracture width achieved and produces smoother fracture faces which reduces friction on fluid flow.

In order to make the fracture 22 as conductive as possible to hydrocarbon fluids contained in the poorly consolidated formation 10, the fracture 22 is propped. That is, as the fracture 22 is extended in the consolidated formation 12 and in the poorly consolidated formation 10, a particulate material propping agent carried into the fracture in suspension in the fracturing fluid is deposited therein. Upon completion of the fracturing treatment, the propping agent remains in the created fracture thereby preventing it from closing and providing a highly permeable flow channel.

The fracturing fluid utilized to create the fractures in accordance with this invention can be any aqueous or non-aqueous fluid that does not adversely react with materials in the formations contacted thereby. Fracturing fluids commonly include additives and components such as gelling agents, crosslinking agents, gelbreakers, surfactants, carbon dioxide, nitrogen and the like. The propping agent used in the fracturing fluid can be any conventional propping agent such as sand, sintered bauxite, ceramics and the like. The preferred propping agent for use in accordance with this invention is sand, and the sand or other propping agent utilized is preferably coated with a resin composition which subsequently hardens to consolidate the propping agent and prevent its movement with produced fluids.

The use of a resin composition coated propping agent to consolidate the propping agent after its deposit in a subterranean zone is described in U.S. Pat. No. 5,128,390 issued on Jul. 7, 1992 to Murphey et al., and such patent is incorporated herein by reference.

A preferred fracturing fluid for use in accordance with the present invention is comprised of an aqueous gelled liquid having a hardenable resin composition coated propping agent, preferably sand, suspended therein. Upon being deposited in the fracture created with the fracturing fluid, the resin coated propping agent is consolidated into a hard permeable mass therein.

Referring now to FIG. 2, a poorly consolidated formation 30 is illustrated positioned below a consolidated boundary formation 32. A well bore 34 is drilled into the consolidated formation 32 which includes a horizontal portion 35 positioned above the poorly consolidated formation 30. The well bore 34 contains casing 36 surrounded by a cement sheath 38.

As will be understood by those skilled in the art, the portion 35 of the well bore 34 is referred to herein as a horizontal well bore even though it may not actually be positioned at 90° from vertical. For example, the well bore portion 35 may penetrate a formation at an angle greater or less than 90° from vertical (often referred to as a deviated wellbore) which substantially parallels the direction of the bedding planes in the formation. Subterranean formations often include synclines and anticlines whereby the bedding planes are not 90° from vertical. As used herein, the term "horizontal well bore" means a well bore or portion thereof which penetrates a formation at an angle of from about 60° to about 120° from vertical.

A plurality of directionally oriented perforations 40 are produced in the lower side of the horizontal portion 35 of the well bore 34. The perforations 40 are aligned in a downward direction so that when a hydraulic pressure is applied to the perforations 40, a downwardly extending fracture 42 is formed. Because of the vertical over-burden induced stress in the consolidated formation 32, the fracture 42 will extend substantially vertically downwardly from the horizontal well bore 34. The angle at which the fracture 42 takes with respect to the axis of the horizontal portion 35 of the well bore 34 depends on the direction of the maximum horizontal stress in the consolidated formation 32. For example, if the maximum horizontal stress in the formation 32 parallels the axis of the well bore portion 35, the fracture 42 will be aligned with the axis of the well bore portion 35 as illustrated in FIG. 2. On the other hand, if the maximum horizontal stress direction is transverse to the axis of the horizontal well bore portion 35, the fracture 42 will be transverse thereto.

After the downwardly aligned perforations 40 are produced, hydraulic pressure is applied to the perforations by pumping a fracturing fluid thereinto and into the consolidated formation 32. The hydraulic pressure is applied in an amount (the fracturing fluid is pumped at a rate and pressure) such that the consolidated formation 32 fractures. As the hydraulic pressure is continued, the fracture 42 extends below the horizontal well bore portion 35 into the poorly consolidated formation 30 as shown in FIG. 2. As described above in connection with the fracture 22, a propping agent, preferably sand coated with a hardenable resin composition, is suspended in the fracturing fluid whereby it is carried into, deposited and formed into a consolidated permeable mass therein.

After forming the propped fracture 42, a second propped fracture 44 and other propped fractures (not shown) can be formed along the length of the horizontal portion 35 of the well bore 34 to provide additional flow channels in the poorly consolidated formation 30 through which hydrocarbon fluids can be produced without also producing sand.

As will now be understood by those skilled in the art, instead of removing formation material from a poorly consolidated formation by forming a well bore therein which causes the breakdown of the formation and the production of sand therefrom, the methods of the present invention add consolidated material (hardened resin consolidated propping agent) to a poorly consolidated formation which increases the overall formation consolidation and resistance to formation breakdown, etc. Further, the creation of conductive fractures in a poorly consolidated formation through which formation fluids are produced converts high pressure draw-down radial flow which occurs in a formation penetrated by a well bore to low pressure draw-down linear flow. This low pressure draw-down linear flow through one or more propped fractures in a poorly consolidated formation prevents the breakdown of the formation and the consequent sand production.

The completion methods of this invention are particularly advantageous when carried out in formations where water coning would occur if the formation fluids were produced through a vertical well bore penetrating the formation.

Thus, the present invention is well adapted to carry out the objects and attain the ends and advantages mentioned as well as those which are inherent therein. While numerous changes in the construction and arrangement of parts may be made by those skilled in the art, such changes are encompassed within the spirit of this invention as defined by the appended claims.

What is claimed is:

1. A method of completing a well in a poorly consolidated subterranean formation bounded by a consolidated formation to prevent the production of sand with formation fluids from the poorly consolidated formation comprising the steps of:

(a) drilling a well bore into said consolidated formation adjacent to said poorly consolidated formation;

(b) creating a propped fracture in said consolidated formation which communicates with said well bore and extends into said poorly consolidated formation; and (c) producing fluids from said poorly consolidated formation into said well bore by way of said propped fracture.

2. The method of claim 1 wherein said fracture is propped with a consolidated resin coated particulate material.

3. The method of claim 2 wherein said particulate material is sand.

4. The method of claim 1 wherein said well bore in said consolidated formation is a substantially vertical well bore.

5. The method of claim 1 wherein said well bore in said consolidated formation is a horizontal well bore positioned above said poorly consolidated formation.

6. The method of claim 4 wherein step (b) comprises:

creating a plurality of directionally oriented perforations in said well bore arranged to produce a fracture intersecting said poorly consolidated formation when hydraulic pressure is applied thereto; and applying hydraulic pressure to said perforations in an amount sufficient to form a fracture in said consolidated formation and extend said fracture into said poorly consolidated formation.

7. The method of claim 6 wherein said perforations are aligned in a direction corresponding with the direction of the maximum horizontal stress in said consolidated boundary formation.

8. The method of claim 5 wherein step (b) comprises:

creating a plurality of directionally oriented perforations in the lower side of said well bore aligned in a downward direction; and applying hydraulic pressure to said perforations in an amount sufficient to fracture said consolidated boundary formation and extend said fracture into said poorly consolidated formation.

9. A method of completing a well in a poorly consolidated subterranean formation bounded by a consolidated formation to prevent the production of sand with formation fluids from the poorly consolidated formation comprising the steps of:

(a) drilling a well bore into said consolidated formation adjacent to said poorly consolidated formation;

(b) creating a plurality of directionally oriented perforations in said well bore arranged to produce a fracture intersecting said poorly consolidated formation;

(c) applying hydraulic pressure to said perforations with a particulate material containing fracturing fluid in an amount sufficient to create a fracture in said consolidated formation, to extend said fracture from said well bore into said poorly consolidated formation and to prop said fracture with said particulate material; and (d) producing fluids from said poorly consolidated formation into said well bore by way of said propped fracture.

10. The method of claim 9 wherein said particulate material is coated with a hardenable resin composition.

11. The method of claim 10 wherein said particulate material is sand.

12. The method of claim 9 wherein said well bore in said consolidated formation is a substantially vertical well bore.

13. The method of claim 9 wherein said well bore in said consolidated formation is a horizontal well bore positioned above said poorly consolidated formation.

14. The method of claim 12 wherein said perforations are aligned in a direction corresponding with the direction of the maximum horizontal stress in said consolidated boundary formation.

15. The method of claim 13 wherein said directionally oriented perforations are created in the lower side of said well bore and are aligned in a downward direction.

16. A method of completing a well in a poorly consolidated subterranean formation bounded by a consolidated formation to prevent the production of sand with formation fluids from the poorly consolidated formation comprising the steps of:

(a) drilling a horizontal well bore into said consolidated boundary formation adjacent to and above said poorly consolidated formation;

(b) creating a plurality of directionally oriented perforations in the lower side of said well bore aligned in a downward direction;

(c) applying hydraulic pressure to said perforations with a particulate material containing fracturing fluid in an amount sufficient to create a fracture in said consolidated formation, to extend said fracture from said well bore into said poorly consolidated formation and to prop said fracture with said particulate material; and (d) producing fluids from said poorly consolidated formation into said well bore by way of said propped fracture.

17. The method of claim 16 wherein said particulate material is coated with a hardenable resin composition.

18. The method of claim 17 wherein said particulate material is sand.

19. The method of claim 18 wherein said fracturing fluid is an aqueous gel.

20. The method of claim 16 wherein said application of hydraulic pressure to said perforations comprises pumping said fracturing fluid by way of said perforations into said consolidated formation and into said fracture formed therein and in said poorly consolidated formation.

* * * * *